United States Patent [19]

Dennis

[11] Patent Number: 4,632,196

[45] Date of Patent: Dec. 30, 1986

[54] DRILL BIT WITH SHROUDED CUTTER

[75] Inventor: Mahlon Dennis, Kingwood, Tex.

[73] Assignee: Strata Bit Corporation, Houston, Tex.

[21] Appl. No.: 614,232

[22] Filed: May 25, 1984

Related U.S. Application Data

[63] Continuation-in-part of Ser. No. 6,467,503, Feb. 18, 1983, abandoned.

[51] Int. Cl.[4] ..... E21B 10/12

[52] U.S. Cl. ..... 175/329; 175/410

[58] Field of Search ..... 175/410, 329, 330

[56] References Cited

U.S. PATENT DOCUMENTS

| | | | |
|---|---|---|---|
| 4,073,354 | 2/1978 | Rowley et al. | 175/329 |
| 4,098,363 | 4/1978 | Rohde et al. | 175/329 |
| 4,156,329 | 5/1979 | Daniels et al. | 51/295 |
| 4,323,130 | 4/1982 | Dennis | 175/329 |
| 4,381,825 | 5/1983 | Radtke | 175/393 |
| 4,396,077 | 8/1983 | Radtke | 175/329 |
| 4,442,909 | 4/1984 | Radtke | 175/329 |
| 4,498,549 | 2/1985 | Jürgens | 175/410 |

OTHER PUBLICATIONS

Chapter entitled Stratapax Bits, pp. 541–591 published in Advanced Drilling Techniques by Sm. C. Maurer, The Petroleum Publishing Company, Oklahoma, publ. 1980.

*Primary Examiner*—James A. Leppink
*Assistant Examiner*—William P. Neuder
*Attorney, Agent, or Firm*—Burns, Doane, Swecker & Mathis

[57] ABSTRACT

A drill bit for connection on a drill string has a hollow tubular body with an end cutting face and an exterior peripheral stabilizer surface with cylindrical sintered carbide inserts positioned in recesses therein having polycrystalline diamond cutting elements mounted on said inserts. The inserts each also have a metal reinforcing shroud secured on the supporting face providing a reinforcement for the polycrystalline diamond cutting elements which is not subject to notch fracture. Each shroud is arranged so that a wall of the associated recess reinforces the shroud against shear forces and reinforces the stud against fracture.

2 Claims, 16 Drawing Figures

FIG. 2
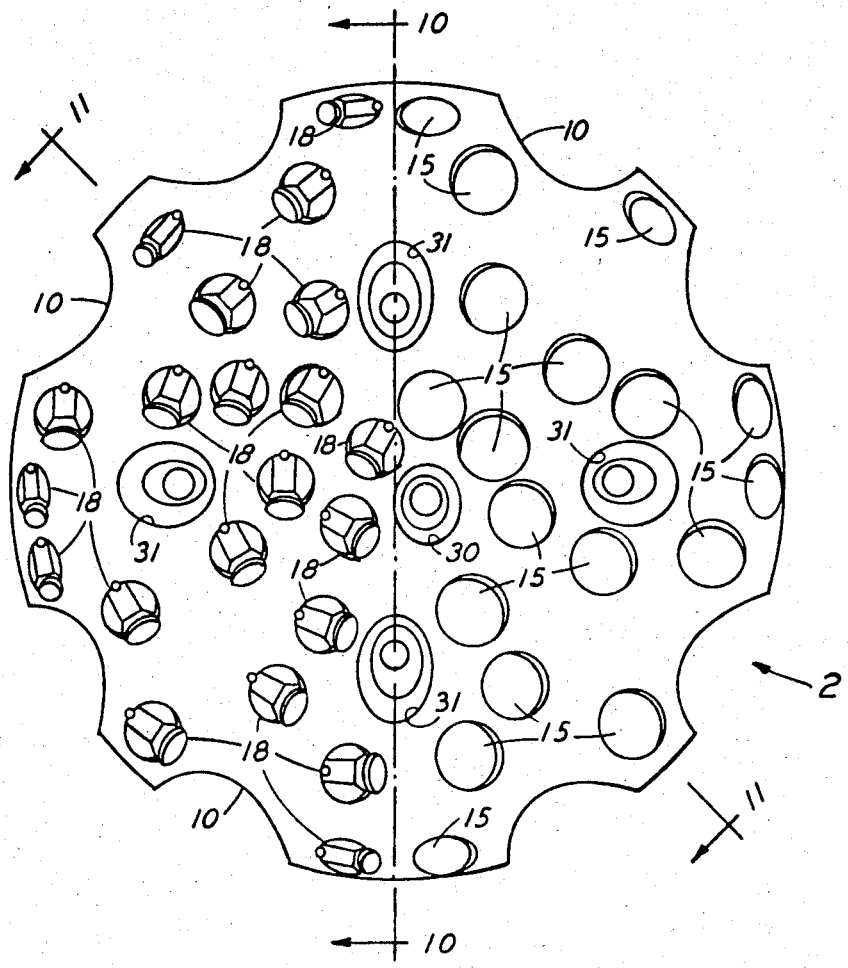
FIG. 5
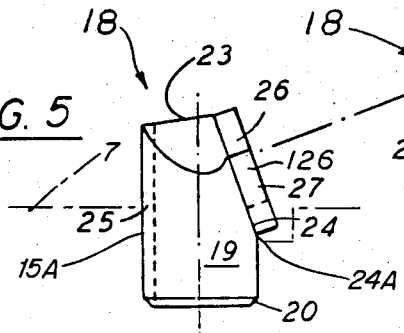
FIG. 6
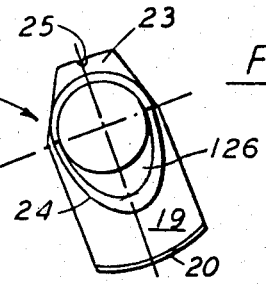
FIG. 5A
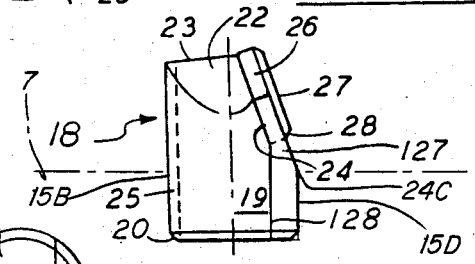
FIG. 7
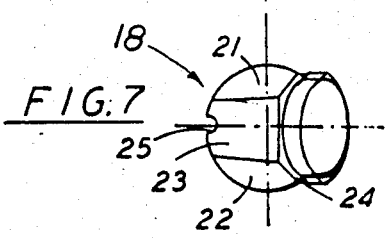
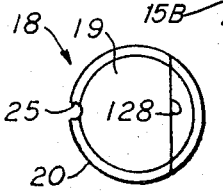
FIG. 5B

DRILL BIT WITH SHROUDED CUTTER

RELATED INVENTIONS

This is a continuation-in-part of U.S. application Ser. No. 06/467,503 filed by Mahlon Dennis on Feb. 18, 1983, and now abandoned.

BACKGROUND OF THE INVENTION

1. Field of the Invention

This invention relates to new and useful improvements in drill bits and more particularly to drill bits having diamond cutting elements and means for reinforcing the cutting elements against shear forces.

2. Brief Description of the Prior Art

Rotary drill bits used in earth drilling are primarily of two major types. One major type of drill bit is the roller cone bit having three legs depending from a bit body which support three roller cones carrying tungsten carbide teeth for cutting rock and other earth formations. Another major type of rotary drill bit is the diamond bit which has fixed teeth of industrial diamonds supported on the drill body or on metallic or carbide studs or slugs anchored in the drill body.

There are several types of diamond bits known to the drilling industry. In one type, the diamonds are a very small size and randomly distributed in a supporting matrix. Another type contains diamonds of a larger size positioned on the surface of a drill shank in a predetermined pattern. Still another type involves the use of a cutter formed of a polycrystalline diamond supported on a sintered carbide support.

Some of the most recent publications dealing with diamond bits of advanced design, relevant to this invention, consists of Rowley et al, U.S. Pat. No. 4,073,354 and Rhode et al U.S. Pat. No. 4,098,363. An example of cutting inserts using polycrystalline diamond cutters and an illustration of a drill bit using such cutters, is found in Daniels et al U.S. Pat. No. 4,156,329.

The most comprehensive treatment of this subject in the literature is probably the chapter entitled STRATAPAX BITS, pages 541–591 in ADVANCED DRILLING TECHNIQUES, by William C. Maurer, The Petroleum Publishing Company, 1421 South Sheridan Road, P.O. Box 1260, Tulsa, Okla. 74101, published in 1980. This reference illustrates and discusses in detail the development of the STRATAPAX diamond cutting elements by General Electric and gives several examples of commercial drill bits and prototypes using such cutting elements.

As is evident from a prior art cutting element 100 depicted in FIG. 12, it is conventional to provide a stud 101 with an angularly oriented supporting surface 102 to which a carbide layer of a disc-shaped element 104 is bonded. A problem which must be dealt with in such an arrangement is a tendency for the disc to be sheared from the supporting surface in response to the forces applied to the disc which can be resolved into a resultant force 106.

In an effort to deal with the shearing-off problem, it has been proposed, as depicted in FIG. 13, to form the supporting surface with a shoulder 110 located just behind, and in contact with, the disc to support the latter against shear forces. However, such a configuration creates a new problem. That is, any change in direction of the surface creates a weakened region which is susceptible to fracture. Thus, the notch 112 at the junction of the surface segments 108, 110 defines a weaker region which renders the stud susceptible to being fractured along a line 114 which propogates from the notch.

SUMMARY OF THE INVENTION

One of the objects of this invention is to provide a new and improved drill bit having diamond insert cutters with reinforcement against shear forces.

Another object is to provide a drill bit having carbide inserts with diamond cutting elements having a supporting reinforcement against shear forces applied to the cutting elements.

A further object is to resist shearing-off of the disc-shaped element while resisting fracture of the stud.

Still another object of this invention is to provide a drill bit having cylindrical carbide inserts with diamond cutting elements secured thereon and a reinforcing metal shroud secured on the supporting face partially surrounding the cutting elements.

Other objects and features of this invention will become apparent from time to time throughout the specification and claims as hereinafter related.

The foregoing objectives are accomplished by a new and improved drill bit as described herein. A drill bit for connection on a drill string has a hollow tubular body with an end cutting face and an exterior peripheral stabilizer surface with cylindrical sintered carbide inserts positioned therein having polycrystalline diamond cutting elements mounted on said inserts. The inserts each also have a metal reinforcing shroud secured on the supporting face providing a reinforcement for the polycrystalline diamond cutting elements which is not subject to notch fracture. The drill bit is also provided with removable and replaceable nozzles.

BRIEF DESCRIPTION OF THE DRAWINGS

FIG. 2 is a plan view of the bottom of the drill bit shown in FIG. 1 showing half of the bit with cutting inserts in place and half without the inserts, showing only the recesses, and also showing the nozzle retaining rings in place.

FIG. 5 is a view in side elevation of one of the cutting inserts with a cutting element reinforcing shroud.

FIG. 5A is a view in side elevation of an alternate embodiment of one of the cutting inserts.

FIG. 5B is a bottom end view of the embodiment shown in FIG. 5A.

FIG. 6 is a view of one of the cutting inserts in plan relative to the surface on which the cutting element is mounted and showing the reinforcing shroud for the cutting elements.

FIG. 7 is a top view of the cutting insert shown in FIG. 5.

DESCRIPTION OF THE PREFERRED EMBODIMENTS

Figure 1:
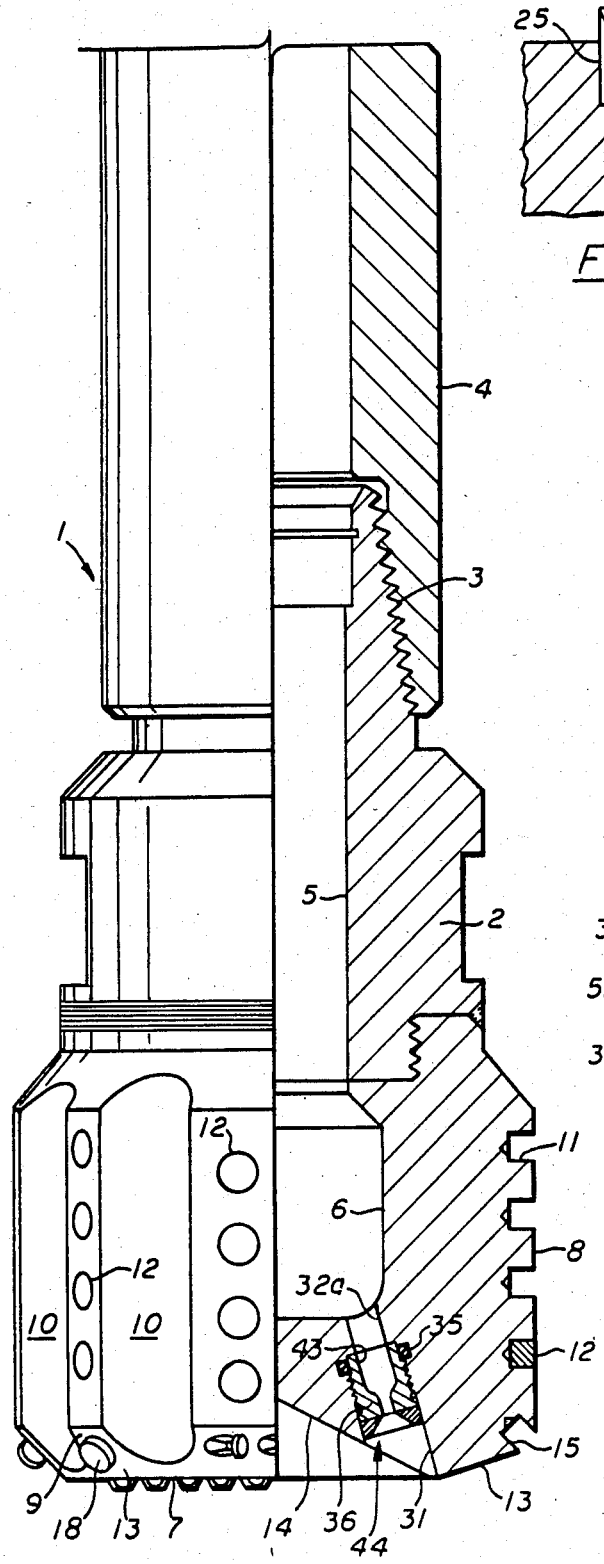
FIG. 1 is a view partly in elevation and partly in quarter section of an earth boring drill bit with diamond-containing cutting inserts incorporating a preferred embodiment of this invention and showing the threaded replaceable nozzle and nozzle retaining ring.

In the following description, unless otherwise noted, the general description of the drill bit is that of the assignee's prior pending applications, viz., Radtke U.S. Ser. No. 220,306, filed Dec. 29, 1980 and now abandoned; Ser. No. 158,389 issued Apr. 6, 1982 as Dennis U.S. Pat. No. 4,323,130; Ser. No. 206,811 issued May 5, 1983 as Radtke U.S. Pat. No. 4,381,825; Ser. No. 303,721 issued Aug. 2, 1983 as Radtke U.S. Pat. No. 4,396,077, and Ser. No. 303,960 issued Apr. 17, 1984 as Radtke U.S. Pat. No. 4,442,909.

Referring to the drawings, there is shown a drill bit 1 having replaceable drilling nozzles held in place by a threaded arrangement. The threaded arrangement for securing nozzles may be used in other types of drill bits but is particularly useful in this bit because of the close proximity of the nozzles to the cutting surface of the bit and the bottom of the drill hole which results in a very high rate of wear.

Many features in the drill bit are described in applicant's above-mentioned U.S. Pat. No. 4,323,130; and abandoned Radtke U.S. Ser. No. 220,306 (which discloses an improved arrangement for securing replaceable nozzles in drilling bits by means of a metal or hard metal retaining ring).

This improved drill bit comprises a tubular body 2 which is adapted to be connected as by a threaded connection 3 to a drill collar 4 in a conventional drill string. The body 2 of drill bit 1 has a longitudinally extending passage 5 terminating in a cavity 6 formed by end wall 7 which is the cutting face of the drill bit. Drill bit 1 has a peripheral stabilizer surface 8 which meets the cutting face 7 at the gauge cutting edge portion 9.

The stabilizer portion 8 has a plurality of grooves or courses 10 which provide for flow of drilling mud or other drilling fluid around the bit during drilling operation. The stabilizer surface 8 also has a plurality of cylindrical holes or recesses 11 in which are positioned hard metal inserts 12. These hard metal inserts 12 are preferably of a sintered carbide and are cylindrical in shape and held in place in recesses 11 by an interference fit with the flat end of the insert being substantially flush with the stabilizer surface 8.

The cutting surface or cutting face 7 of the drill bit body 2 is preferably a crown surface defined by the intersection of outer conical surface 13 and inner negative conical surface 14. Crown surfaces 13 and 14 have a plurality of sockets or recesses 15 spaced in a selected pattern. In FIG. 2, it is seen that the sockets or recesses 15 and the cutting inserts which are positioned therein are arranged in substantially a spiral pattern.

Figure 3:
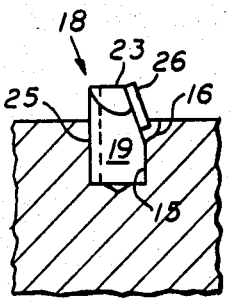
FIG. 3 is a sectional view taken normal to the surface of the drill bit through one of the recesses in which the cutting inserts are positioned and showing the insert in elevation.
Figure 4:
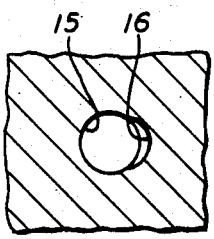
FIG. 4 is a sectional view in plan showing the hole or recess in which the cutting insert is positioned.
Figure 8:
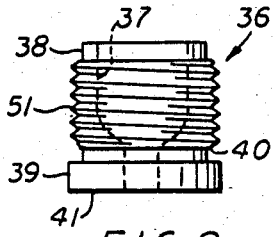
FIG. 8 is a view in elevation of one of the replaceable nozzle members.

In FIGS. 3 and 4, the sockets or recesses 15 are shown in more detail with the cutting inserts being illustrated. Each of the recesses 15 is provided with a milled offset recess 16 extending for only part of the depth of the recess 15. The recesses 15 in crown faces 13 and 14 receive a plurality of cutting elements 18 which are seen in FIGS. 1 and 2 and are shown in substantial detail in FIGS. 3, 5, 5A, 5B, 6 and 7.

Cutting elements 18 which were previously used were the STRATAPAX cutters manufactured by General Electric Company and described in Daniels et al U.S. Pat. No. 4,156,329, Rowley et al U.S. Pat. No. 4,073,354 and in considerable detail in ADVANCED DRILLING TECHNIQUES by William C. Maurer. The STRATAPAX cutting elements 18 consist of a cylindrical supporting stud 19 of sintered carbide. Stud 19 is beveled at the bottom as indicated at 20, has edge tapered surfaces 21 and 22, a top tapered surface 23 and an angularly oriented supporting surface 24.

A small cylindrical groove 25 is provided along one side of supporting stud 19. A disc-shaped cutting element 26 is bonded on angular supporting surface 24, preferably by brazing or the like. Disc-shaped cutting element 26 is a sintered carbide disc having a cutting surface 27 comprising polycrystalline diamond.

Figure 9:
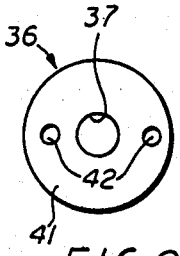
FIG. 9 is a bottom end view of the nozzle shown in FIGS. 8 and 8A.
Figure 8A:
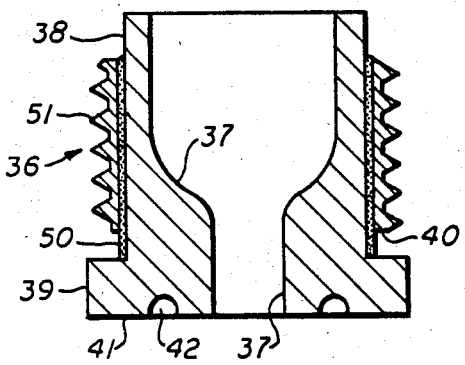
FIG. 8A is a view in central section, slightly enlarged, of the nozzle member shown in FIG. 8.

In extensive commercial use, it has been found that the diamond cutting elements 26 are subjected to severe shear forces during drilling which sometimes results in cutting element failure by fracturing the cutting element from the supporting stud 19. It has been suggested that the problem of shear fracture of the cutting elements 26 from the supporting face 24 with a reinforcing shoulder 110 (FIG. 9) which would support the cutting elements against shear forces.

This has proved to be impractical because of the physical properties of the supporting stud 19. The supporting studs 19 are constructed of tungsten carbide which is a very hard material but is also a very brittle material. If the supporting face of the stud is provided with a shoulder to reinforce the cutting elements 26 against shear, the notch 112 (FIG. 9) which is formed in the surface is a focal point for notch fracture. In shear, a notch in a highly brittle material, such as tungsten carbide, becomes a focal point for early failure. The shear loads and also the impact loads cause fractures to start at and propagate from the notch.

In the preferred embodiment of this invention, the carbide studs 19 have the diamond cutting elements 26 brazed thereon, as in the conventional STRATAPAX type cutters. In addition, a reinforcing metal shroud 126 is brazed to supporting surface 24 in abutting relation to cutting element 26 and surrounding the cutting element disc for about half of its circumference. The supporting shroud 126 is preferably a strong, heat-resistant, steel alloy or cemented tungsten carbide which is brazed to the supporting surface 24 and provides reinforcement or support for the cutting element discs 25 against shear and impact forces both in the direction of rotation of the bit and from the sides.

Supporting studs 19 of cutting elements 18 and the diameter of recesses 15 are sized so that cutting elements 18 will have a tight interference fit in the recesses 15. The recesses 15 are oriented so that when the cutting elements are properly positioned therein the disc-shaped diamond faced cutters 26 will be positioned with the cutting surfaces facing the direction of rotation of the drill bit. When the cutting elements 18 are properly positioned in sockets or recesses 15, the cutting elements 26 on supporting stud 19 are aligned with the milled recesses 16 on the edge of the socket or recess 15.

Figure 13:
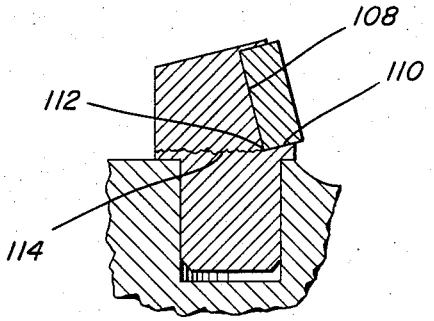
FIG. 13 (PRIOR ART)
FIG. 13 is a longitudinal sectional view through another prior art type of cutting insert.

As can be seen in FIG. 5, a counterbore is provided which accommodates the shroud 126 and locates the lower end 24A of the supporting surface 24 beneath the cutting face 7. Since a change in direction of the surface 24 occurs at the end 24A, the surface is somewhat weaker there and would ordinarily be susceptible to fatigue failure. However, by mounting the stud to such a depth that the end 24A is located opposite, and reinforced by, a portion 15A of the recess, the type of fracture of the stud which is depicted by the line 114 in FIG. 13 is effectively resisted.

In FIGS. 5A and 5B, there is shown an alternate form of cutting element 18 in which the side surface of the supporting stud 19 has a flat 128 cut or formed therein parallel to the longitudinal axis thereof. The supporting shroud 127 in this embodiment is a single piece of metal which is brazed to the stud along the flat 128 and abuts the lower half of disc 26. The side surface of the shroud 127 forms a circumferential continuation of the side surface of the stud. The envelope or projection of the cylindrical surface of the supporting stud 19 is as large or larger than the outermost extension of the cutting disc 26 which permits the cutting elements to be sunk into the surface of the bit body without the necessity of enlarging the bore of the hole in which the stud is positioned. If desired, the cutting surface 27 of polycrystalline diamond on disc-shaped cutter 26 may be beveled around the peripheral edge as indicated at 28.

Since a change in direction of the surface 24 occurs at a location 24C situated opposite, and reinforced by a portion 15B of the recess, fracture of the stud along the bevel of the location 24C is resisted. Furthermore, not only does the shroud 127 reinforce the disc-shaped element 26 against shear forces, but the shroud itself is reinforced against shear forces by the wall section 15D of the recess.

Figure 10:
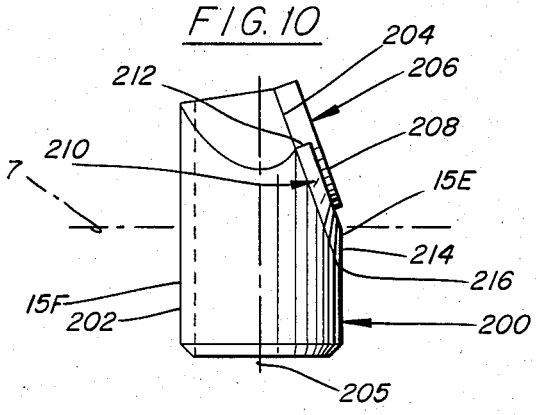
FIG. 10 is a view in side elevation of another alternate embodiment of one of the cutting inserts with a reinforcing shroud.
Figure 11:
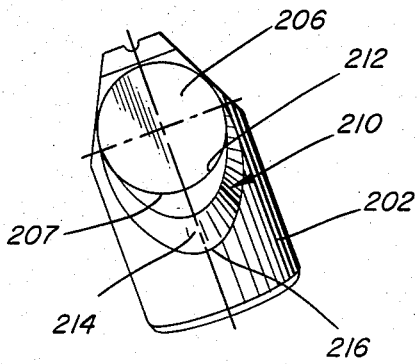
FIG. 11 is a front view of the cutting insert and shroud according to FIG. 10 taken in a direction parallel to the center axis of the diamond disc.
Figure 12:
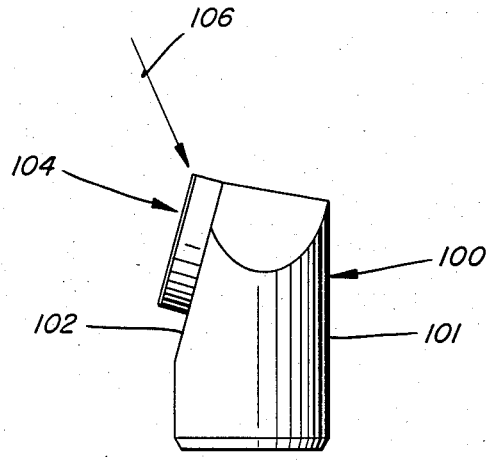
FIG. 12 (PRIOR ART)
FIG. 12 is a side elevational view of a prior art type of cutting insert.

Another preferred embodiment of the invention is depicted in FIGS. 10 and 11. In that embodiment a carbide stud 200 has a cylindrical side surface 202 and an angularly oriented supporting surface 204 at its outer end which extends from the side surface 202 toward a central axis 205 of the stud. A disc-shaped cutting element 206 is bonded to the supporting surface 204 and includes a polycrystalline diamond cutting surface 208.

Bonded to the supporting surface behind, and in contact with, the disc-shaped element is a shroud 210. The shroud has a curvalinear contact face 212 which contacts a cylindrical peripheral surface 207 of the disc-shaped element, and a side surface 214 shaped complementarily to the side surface 202 of the stud, i.e., the shroud side surface 214 is shaped cylindrically to constitute a correspondingly shaped continuation of the stud side surface 202 in the longitudinal and circumferential directions.

The disc-shaped element 206 is so sized and oriented relative to the stud that the disc-shaped element is located inside of a longitudinal projection of the stud side surface 202. In that manner, the stud can be inserted to any depth within the bit body without the risk of damage to the disc-shaped element.

Insertion of the stud by interference fit into the recess results in the side surface 214 of the shroud abutting against the wall portion 15E of the recess. Thus, the wall 15E of the recess reinforces the shroud against shear forces transmitted thereto by the disc-shaped element 206 during a cutting operation. Furthermore, a change of direction 216 in the supporting surface 204 occurs at the junction between that surface 204 and the side surface 202 of the stud, which junction is located opposite a wall portion 15F of the recess. Thus, a tendency for the stud to fracture along a fracture line propagating from the junction 216 will be effectively resisted by the wall portion 15F.

It will thus be appreciated that the shroud according to FIGS. 10, 11 causes the recess wall to provide reinforcement against both (i) shearing-off of the element 206 and the shroud 210, and (ii) fracture of the stud.

It is to be noted that in the process of bonding the shroud to the supporting surface in any of the embodiments previously described, the supporting surface should be cleaned to remove all surface stresses, oxidation layers, and metallurgical anomalies.

The drill bit body 2 has a centrally located nozzle passage 30 and a plurality of equally spaced nozzle passages 31 toward the outer part of the bit body. Nozzle passages 30 and 31 provide for the flow of drilling fluid, i.e., drilling mud or the like, to keep the bit clear of rock particles and debris as it is operated. The outer nozzle passages 31 are preferably positioned in an outward angle of about 10–25° relative to the longitudinal axis of the bit body. The central nozzle passage 30 is preferably set at an angle of about 30° relative to the longitudinal axis of the bit body. The outward angle of nozzle passages 31 directs the flow of drilling fluid toward the outside of the bore hole and preferably ejects the drilling fluid at about the peak surface of the crown surface on which the cutting inserts are mounted.

The arrangement of nozzle passages and nozzles provides a superior cleaning action for removal of rock particles and debris from the cutting area when the drill bit is being operated. The proximity of the nozzles to the cutting surface, however, causes a problem of excessive wear which has been difficult to overcome. The erosive effect of rock particles at the cutting surface tends to erode the lower end surface of the bit body and also tends to erode the metal surrounding the nozzle passages. In the past, snap rings have usually been used to hold nozzles in place and these are eroded rapidly during drilling with annoying losses of nozzles in the hole.

Central nozzle passage 30 comprises passage 32 extending from drill body cavity 6 with a counterbore 33 cut therein providing a shoulder 43. Counterbore 33 is provided with a peripheral groove 34 in which there is positioned an O-ring 35. Counterbore 33 is internally threaded as indicated at 33*a* and opens into an enlarged smooth bore portion 38 which opens through the lower end portion or face of the drill bit body. Nozzle member 36 is threadedly secured in counterbore 33 against shoulder 43 and has a passage 37 providing a nozzle for discharge of drilling fluid. Nozzle member 36 is a removable and interchangeable member which may be removed for servicing or replacement or for interchange with a nozzle of a different size or shape, as desired. The threaded arrangement for securing the nozzles in place is described more fully in the aforementioned Radtke U.S. Pat. No. 4,381,825, Radtke U.S. Pat. No. 4,396,077, and Radtke U.S. Pat. No. 4,442,909, but is not part of this invention.

OPERATION

The operation of this drill bit should be apparent from the foregoing description of its component parts and method of assembly. Nevertheless, it is useful to restate the operating characteristics of this novel drill bit to make its novel features and advantages clear and understandable.

The drill bit as shown in the drawings and described above is primarily a rotary bit of the type having fixed diamond surfaced cutting inserts. Many of the features described relate to the construction of a diamond bit of a type already known. However, these features are used in the bit in which the improved diamond cutter arrangement of this invention is used.

This arrangement for retention of the removable and interchangeable nozzle members is useful in a diamond bit as described and shown herein but would also be of like use in providing for the retention of removable and interchangeable nozzle member in roller bits, particularly when equipped with extended nozzles, or any other bits which have a flow of drilling fluid through the bit body and out through a flow directing nozzle. The threaded arrangement for releasably securing the nozzle members in place is therefore considered to be of general application and not specifically restricted to the retention of nozzles in diamond cutter insert type bits.

This drill bit is rotated by a drill string through the connection by means of the drill collar 4 shown in FIG. 1. Diamond surfaced cutting elements 18 cut into the rock or other earth formations as the bit is rotated and the rock particles and other debris is continuously flushed by drilling fluid, e.g., drilling mud, which flows through the drill string and the interior passage 5 of the drill bit and is ejected through nozzle passages 30 and 31 as previously described. The central nozzle 30 is set at an angle of about 30° to flush away cuttings and debris from the inside of the cutting crown. The outer nozzle passages 31 are set at an angle of 10–25° outward relative to the longitudinal axis of the drill bit body. These nozzle passages emerge through the cutting face at about the peak of the crown cutting surface. This causes the drilling fluid to be ejected toward the edges of the bore hole and assists in flushing rock particles and cuttings and debris away from the cutting surface.

The peripheral or stabilizer surface 8 of drill bit body 2 is provided with a plurality of sintered carbide cylindrical inserts 12 positioned in sockets or recesses 11 which protect against excessive wear and assist in keeping the bore hole to proper gauge to prevent the drill bit from binding in the hole. The grooves or courses 10 in stabilizer surface 8 provide for circulation of drilling fluid, i.e., drilling mud, past the drill bit body 2 to remove rock cuttings and debris to the surface.

As previously pointed out, the construction and arrangement of the cutting elements and the method of assembly and retention of these elements is especially important to the operation of this drill bit. The drill bit is designed to cut through very hard rock and is subjected to very substantial stresses. The cutting elements 18 are STRATAPAX type cutting elements or similar polycrystalline diamond, (STRATAPAX is the trademark of General Electric Company) modified as described above. These cutting elements consist of diamond surfaced cutting discs supported on carbide studs with reinforcing metal shrouds provided as described above. The milled recess 16 adjacent to the socket or recess 15 in which cutting element stud 19 is fitted allows for cutting disc 26 and shroud 126 to be partially recessed below the surface of the cutting face of the drill bit and also provides for relieving the stress on the drill bit during the cutting operation. The shroud 126 reinforces and protects the cutting element discs against shear and impact loads as previously mentioned.

The shrouds 127 and 210 engage the wall of the recess such that the recess wall resists shearing-off of the shroud as well as fracture of the stud.

While this invention has been described fully and completely with special emphasis upon a single preferred embodiment, it should be understood that within the scope of the appended claims, the invention may be practiced otherwise than as specifically described herein.

What is claimed is:

1. A cutting element positionable by interference fit in a recess of a drill bit body, said cutting element comprising:

a stud having a cylindrical side surface and an angularly oriented supporting surface disposed at a forward end of said stud, said supporting surface oriented at an acute angle relative to a longitudinal axis of said stud and intersecting said side surface, a circular disc-shaped cutting element bonded to said supporting surface and comprising a carbide layer having a cutting surface thereon of polycrystalline diamond, said cutting element including a cylindrical peripheral surface, and a separate reinforcing shroud bonded to said supporting surface behind said disc-shaped element, said shroud including a contact face engaging said peripheral surface of said disc-shaped element, and a cylindrical side surface arranged flush with said side surface of said stud to define a continuation thereof.

2. A drill bit comprising:

a bit body having a hollow tubular body adapted to be connected to a drill string, said bit body having an exterior peripheral stabilizer surface and an end cutting face;

said end cutting face having a plurality of cylindrical recesses spaced therearound in a selected pattern, each recess including a cylindrical wall, a plurality of cutting elements positioned in respective ones of said recesses by interference fit, each cutting element comprising:

a carbide stud having a cylindrical side surface and an angularly oriented supporting surface disposed at a forward end of said stud, said supporting surface oriented at an acute angle relative to a longitudinal axis of said stud and intersecting said side surface, a circular disc-shaped cutting element bonded to said supporting surface and comprising a carbide layer having a cutting surface thereon of polycrystalline diamond, said cutting element including a cylindrical peripheral surface, and a separate reinforcing shroud bonded to said supporting surface behind said disc-shaped element, said shroud including a contact face for engaging said peripheral surface of said disc-shaped element, and a cylindrical side surface extending to a junction defined by said supporting surface and said side surface of said stud, said side surface of said shroud arranged flush with said side surface of said stud to define a continuation thereof.

* * * * *